US007765635B2

(12) United States Patent
Park

(10) Patent No.: US 7,765,635 B2
(45) Date of Patent: Aug. 3, 2010

(54) CLEANING ROBOT

(75) Inventor: Jong Il Park, Kunpo-si (KR)

(73) Assignee: LG Electronics Inc., Seoul (KR)

( * ) Notice: Subject to any disclaimer, the term of this patent is extended or adjusted under 35 U.S.C. 154(b) by 103 days.

(21) Appl. No.: 11/848,683

(22) Filed: Aug. 31, 2007

(65) Prior Publication Data

US 2008/0052867 A1 Mar. 6, 2008

(30) Foreign Application Priority Data

Sep. 5, 2006 (KR) ..... 10-2006-0085230

(51) Int. Cl.
*A47L 5/00* (2006.01)

(52) U.S. Cl. ..... 15/319; 15/339

(58) Field of Classification Search ..... 15/319, 15/339, 340.1

See application file for complete search history.

(56) References Cited

U.S. PATENT DOCUMENTS

| | | | | |
|---|---|---|---|---|
| 6,076,226 | A | 6/2000 | Reed | |
| 6,999,850 | B2 * | 2/2006 | McDonald | 700/245 |
| 7,103,449 | B2 | 9/2006 | Woo et al. | |
| 7,272,868 | B2 * | 9/2007 | Im et al. | 15/319 |
| 7,402,974 | B2 * | 7/2008 | Jeon | 318/567 |
| 2004/0117064 | A1 | 6/2004 | McDonald | |
| 2004/0244138 | A1 * | 12/2004 | Taylor et al. | 15/319 |
| 2005/0132522 | A1 | 6/2005 | Im et al. | |
| 2005/0137749 | A1 | 6/2005 | Jeon et al. | |
| 2005/0166354 | A1 * | 8/2005 | Uehigashi | 15/319 |
| 2006/0053580 | A1 | 3/2006 | Woo | |
| 2007/0039293 | A1 | 2/2007 | Baek et al. | |

FOREIGN PATENT DOCUMENTS

| | | |
|---|---|---|
| EP | 1547512 | 6/2005 |
| EP | 1635237 | 3/2006 |
| GB | 2313191 | 11/1997 |
| KR | 10-2006 0024202 | 3/2006 |
| WO | 02/39868 | 5/2002 |

OTHER PUBLICATIONS

English language Abstract of KR 10-2006-0024202.

* cited by examiner

*Primary Examiner*—Dan Van Nguyen
(74) *Attorney, Agent, or Firm*—Birch, Stewart, Kolasch & Birch LLP

(57) ABSTRACT

A cleaning robot is provided having a drop-off detector provided on a case. The drop-off detector may be configured to contact a surface to be cleaned during movement of the robot. In this regard, the drop-off detector determines the presence or absence of a drop-off via a contact-state between the drop-off detector and the surface.

8 Claims, 14 Drawing Sheets

CLEANING ROBOT

This application claims the benefit of Korean Patent Application No. 10-2006-0085230, filed on Sep. 5, 2006, the entire contents of which is hereby incorporated by reference in its entirety.

BACKGROUND OF THE INVENTION

1. Field of the Invention

The present invention relates to a cleaning robot, and more particularly, to a cleaning robot which can detect a drop-off.

2. Description of the Conventional Art

A cleaning robot is a kind of mobile robot which absorbs dust and foreign material while moving by itself in a certain space such as a house or an office.

The aforementioned cleaning robot includes a traveling means including right and left wheel motors for moving the cleaning robot, a detection sensor for detecting and avoiding a variety of obstacles within a cleaning area, and a control means for controlling the traveling means and the detection sensor to perform cleaning, as well as the components of a general vacuum cleaner which absorbs dust and foreign material.

However, a drop-off sensor of the cleaning robot according to the conventional art is problematic in that even a normal floor is mistaken as a drop-off depending on the material of the floor, the degree of reflection, the color, etc., because an optical sensor is used.

SUMMARY OF THE INVENTION

In one aspect of the present invention, a cleaning robot is provided which detects a floor by direct contact with the floor.

In one non-limiting embodiment, a cleaning robot may include a case and a drop-off detector provided on the case. The drop-off detector may be configured to contact a surface to be cleaned during movement of the robot, the drop-off detector determining the presence or absence of a drop-off via a contact-state between the drop-off detector and the surface. Additionally, the drop-off detector may include a contact bar provided on the case, the contact bar being configured to contact the surface, and a motion detector provided on either one of the case and the contact bar. In this regard, the motion detector may detect relative rotation or relative movement of the contact bar during movement of the robot.

In an additional aspect, a hinge may be provided to connect the contact bar to the case. In this regard, the contact bar may be configured to rotate about the hinge during movement of the robot. Additionally, an installation slot may be provided on the case to receive the contact bar, and the motion detector is provided within the installation slot.

In yet still another aspect, the contact bar may be coupled to the case and configured to be deflected by contacting the surface during movement of the robot. Additionally, the contact bar may include a deflector that is configured to be deflected and is coupled to the case, and a vertically extending contact extending from the deflector toward the surface. Further, the deflector may be provided extending generally horizontally to the surface.

In an additional aspect, the motion detector may include a switch provided on either one of the front and rear sides of the robot with respect to a movement direction of the robot. Further, the drop-off detector may include a surface contact provided at an end of the contact bar which is proximate the surface.

According to another aspect, the drop-off detector may include a roller provided proximate the surface at an end of the contact bar.

In an additional aspect, the drop-off detector may include a contact bar configured to move in generally upward and downward directions with respect to the surface, and a motion detector provided between the case and the contact bar, the motion detector being configured to detect the position of the contact bar. For example, an elastic element may be provided to supply an elastic force to the contact bar, provided between the case and the contact bar. In this regard, the elastic element may be provided between the case and the contact bar.

According to another aspect, a stopper which prevents the contact bar from being separated from the case may be provided on either one of the case and the contact bar. Additionally, the motion detector may include a first electrode provided on the contact bar, and a second electrode provided on the case, the first and second electrodes interacting, e.g., the first and second electrodes may be configured to electrically contact each other.

In accordance with another aspect, the installation slot provided on the case and receiving one end of the contact bar may be provided (or positioned) in a direction which forms either a predetermined angle to the surface or is generally orthogonal to the surface. Additionally, the drop-off detector may include a roller provided at an end of the contact bar and configured to contact the surface.

In another non-limiting embodiment, a method of detecting a drop-off in a cleaning robot includes providing a case and a drop-off detector on the case. In this regard, when the drop-off detector contacts a surface to be cleaned during movement of the robot the drop-off detector determines the absence of a drop-off, and operating the cleaning robot such that when the drop-off detector does not contact the surface the drop-off detector determines the presence of a drop-off. Additionally, the method may include providing a drop-off detector with a contact bar and motion detector, providing the contact bar on the case, and configuring the contact bar to contact the surface when the robot moves on the surface. The method may also include providing the motion detector on either one of the case and the contact bar to detect either relative rotation or relative movement of the contact bar during movement of the robot.

BRIEF DESCRIPTION OF THE DRAWINGS

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Hereinafter, exemplary embodiments of a cleaning robot according to the present invention will be described in detail with reference to the accompanying drawings.

Several non-limiting embodiments of a cleaning robot according to the present invention are explained hereinafter.

Figure 1:
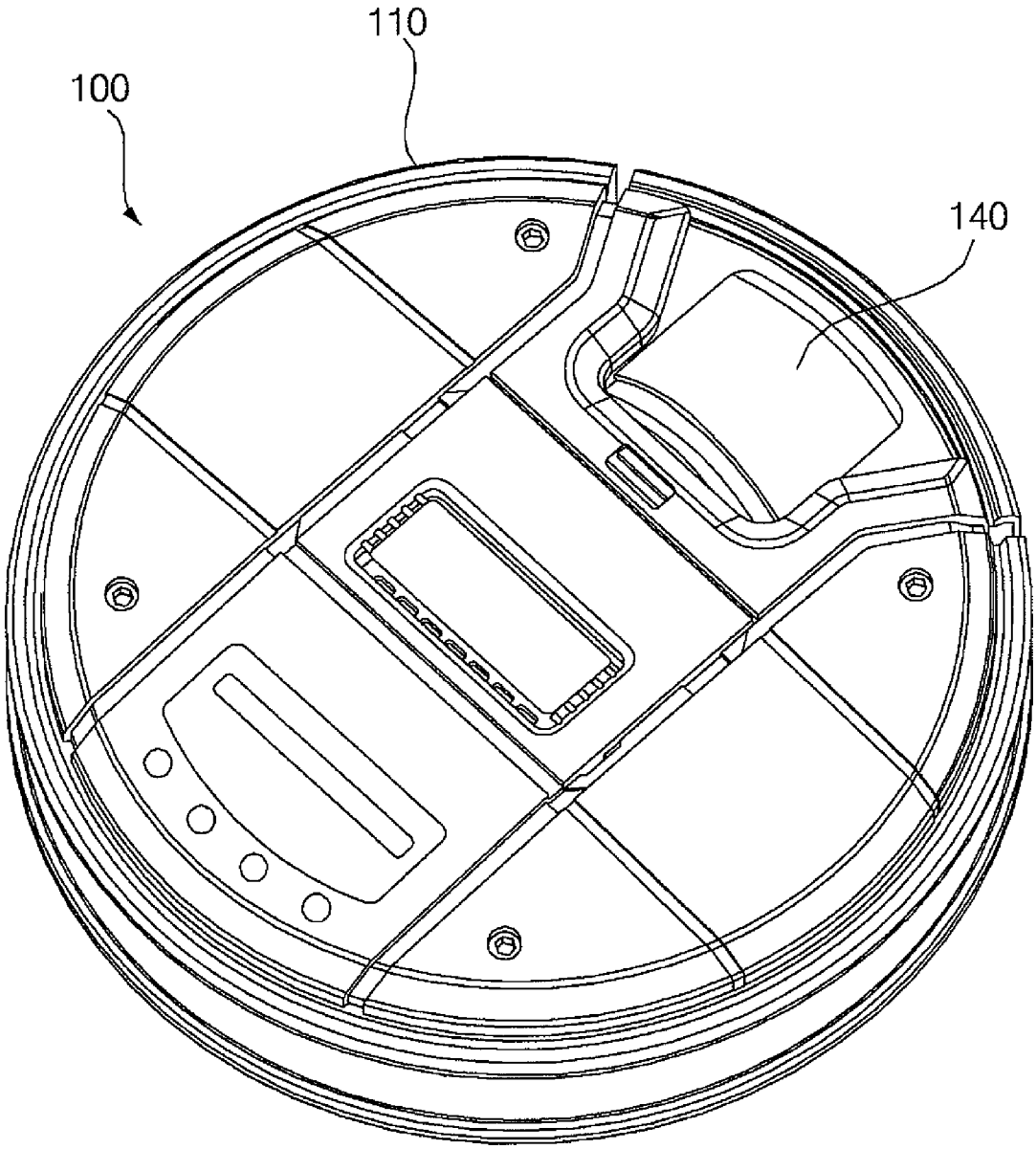
FIG. 1 is a perspective view illustrating a dust collector of a cleaning robot according to a first embodiment of the present invention.
Figure 2:
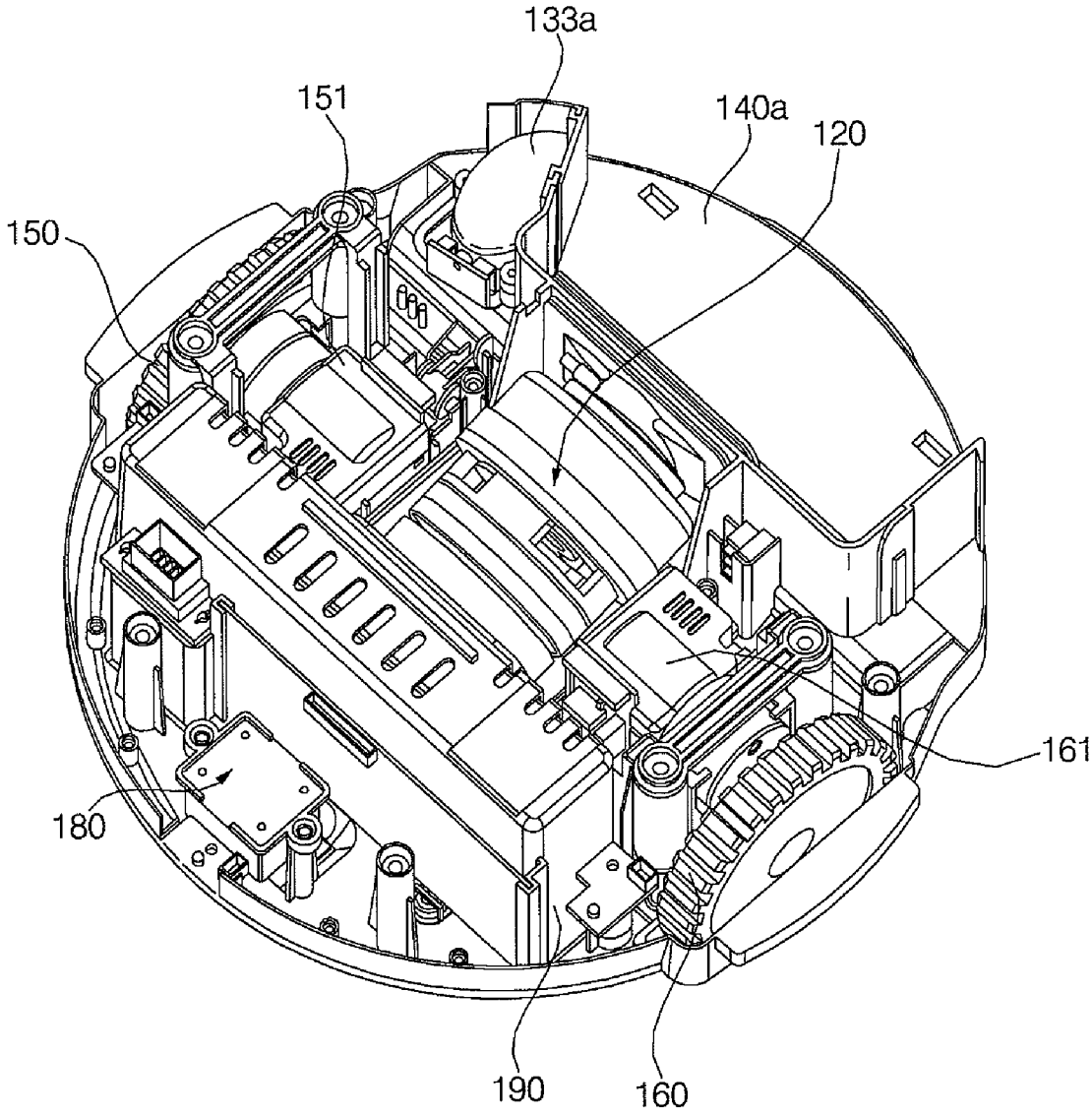
FIG. 2 is a perspective view illustrating an internal structure of the cleaning robot as illustrated in FIG. 1.
Figure 3:
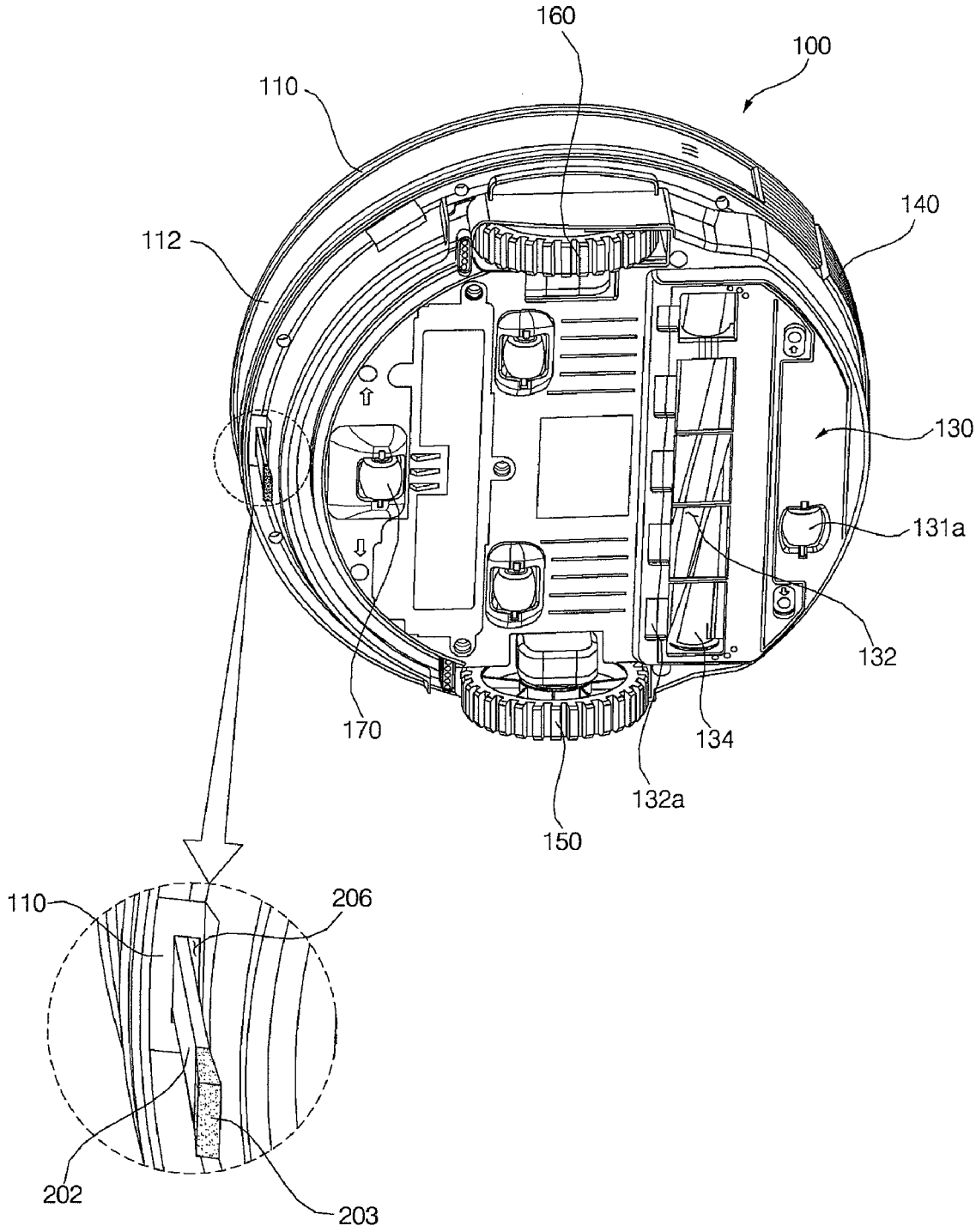
FIG. 3 is a perspective view illustrating the bottom part of the cleaning robot as illustrated in FIG. 1.

FIG. 1 is a perspective view illustrating a dust collector of a cleaning robot according to a first embodiment of the present invention. FIG. 2 is a perspective view illustrating an internal structure of the cleaning robot as illustrated in FIG. 1. FIG. 3 is a perspective view illustrating the bottom part of the cleaning robot as illustrated in FIG. 1.

Referring to FIGS. 1 to 3, the cleaning robot 100 may include a case 110 forming the outer appearance (e.g., the exterior of the case), an air suction device 120 installed inside the case 110, the air suction device 120 may be configured to suction air at the lower part of the case 110 and to discharge the air out of the case 110, a suction nozzle unit 130 may be installed on the case 110 and connected to the air suction device 120. The air suction device 120 may have an agitator 134 installed therein for providing a flow path for suctioning external air and floating (or agitating) dust on the floor, and a dust collector for separating foreign material suctioned by the suction nozzle unit 130 from air and collecting the foreign material.

The case 110 may be formed in a generally round disk (or circular) shape having a predetermined height. However, one of ordinary skill in the art would appreciate that a case having any suitable shape may be employed.

The air suction device 120, the suction nozzle unit 130, and the dust collector 140 which communicates with the suction nozzle unit 130 may be provided inside the case 110.

In addition, a sensor (not shown) for sensing the distance to an indoor wall or an obstacle and a bumper 112 for cushioning a shock upon collision may be provided on the case 110. Left and right driving wheels 150 and 160 for moving the cleaning robot 100 may be provided at lower parts of the case 110, respectively.

The left and right driving wheels 150 and 160 may be configured to rotate by a left wheel motor 151 and a right wheel motor 161 that are controlled by a controller 180. The cleaning robot moves forward and backward, turns, and rotates depending on the rotation direction and rotation ratio of the left and right wheel motors 151 and 161.

At least one auxiliary wheel 170 may be provided on the bottom of the case 110 to prevent the bottom surface of the case 110 from direct contact with the floor thereby minimizing friction between the cleaning robot and the floor.

The internal construction of the cleaning robot 100 will be described in more detail. A controller 180 having various mounting parts disposed therein for controlling the driving of the cleaning robot 100 may be provided at the front side of the case 110, and a battery 190 for supplying power to each part of the cleaning robot may be provided at the rear side of the controller 180.

The air suction device 120 which generates an air suction force may be installed at the back of the battery 190, and a dust collector mounting portion 140*a* may be installed at the back of the air suction device so as to install the dust collector 140 thereon. The dust collector 140 may be structured such that it is fixed to the dust collector mounting portion 140*a*. For example, the dust collector 140 may be detachably connected to the mounting portion 140*a*.

The suction nozzle unit 130 may be provided at the lower side of the dust collector 140, thereby suctioning air and foreign material on the floor.

The air sucking device 120 may include a motor (not shown) installed with a slope between the battery 190 and the dust collector 140 and electrically connected to the battery 190 and a fan (not shown) connected to a rotary shaft of the motor for forcing an air flow.

The suction nozzle unit 130 may be installed so as to face the bottom of the case 110 so that a suction port 132 is exposed to the lower side of the case 110.

As discussed above, the suction nozzle unit 130 may suction foreign material on a surface, e.g., on the floor of an indoor space, and will be described in more detail with reference to FIGS. 4 and 5.

Figure 4:
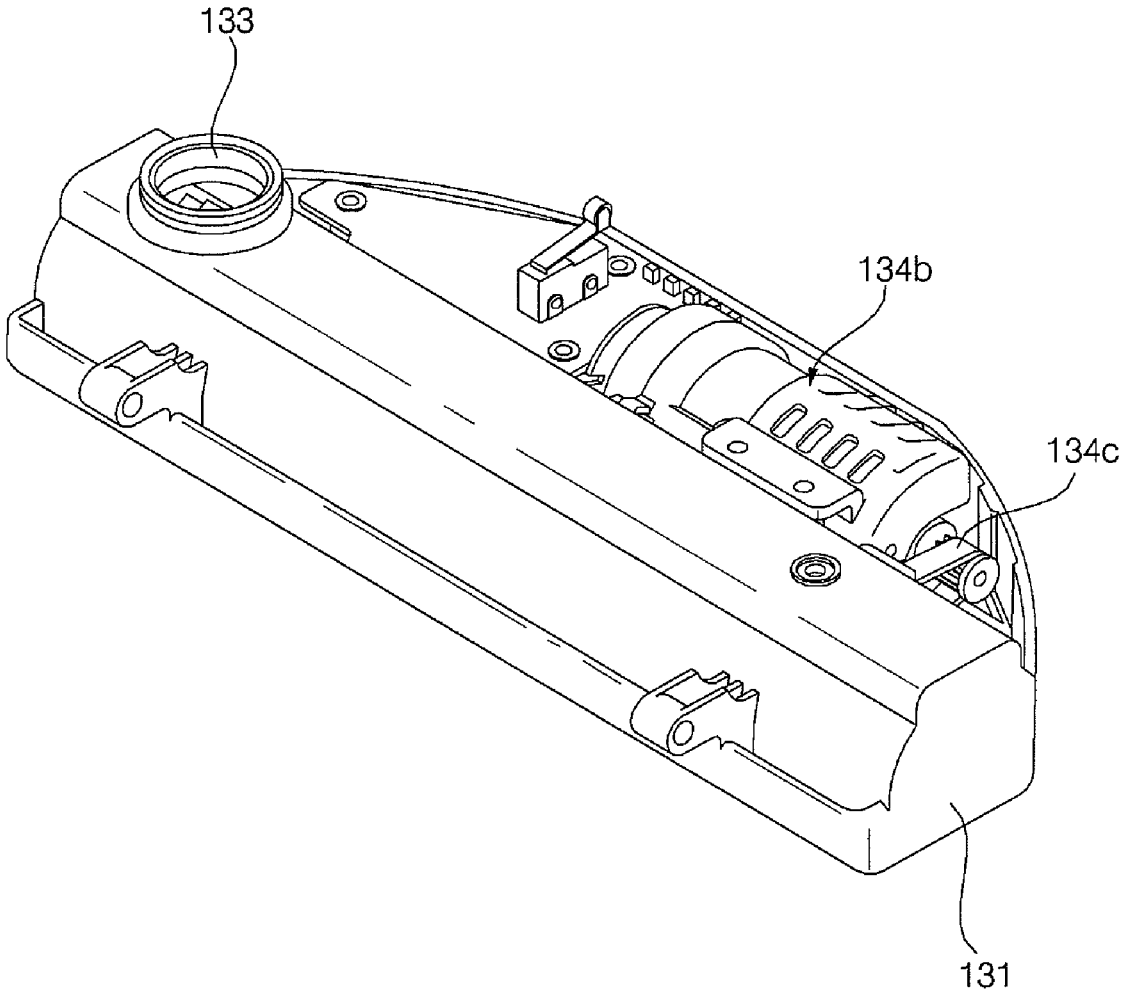
FIG. 4 is a top perspective view illustrating a suction nozzle unit of the cleaning robot as illustrated in FIG. 2.

FIG. 4 is a top perspective view illustrating a suction nozzle unit of the cleaning robot as illustrated in FIG. 2. FIG. 5 is a bottom perspective view illustrating a suction nozzle unit of the cleaning robot as illustrated in FIG. 2.

Figure 5:
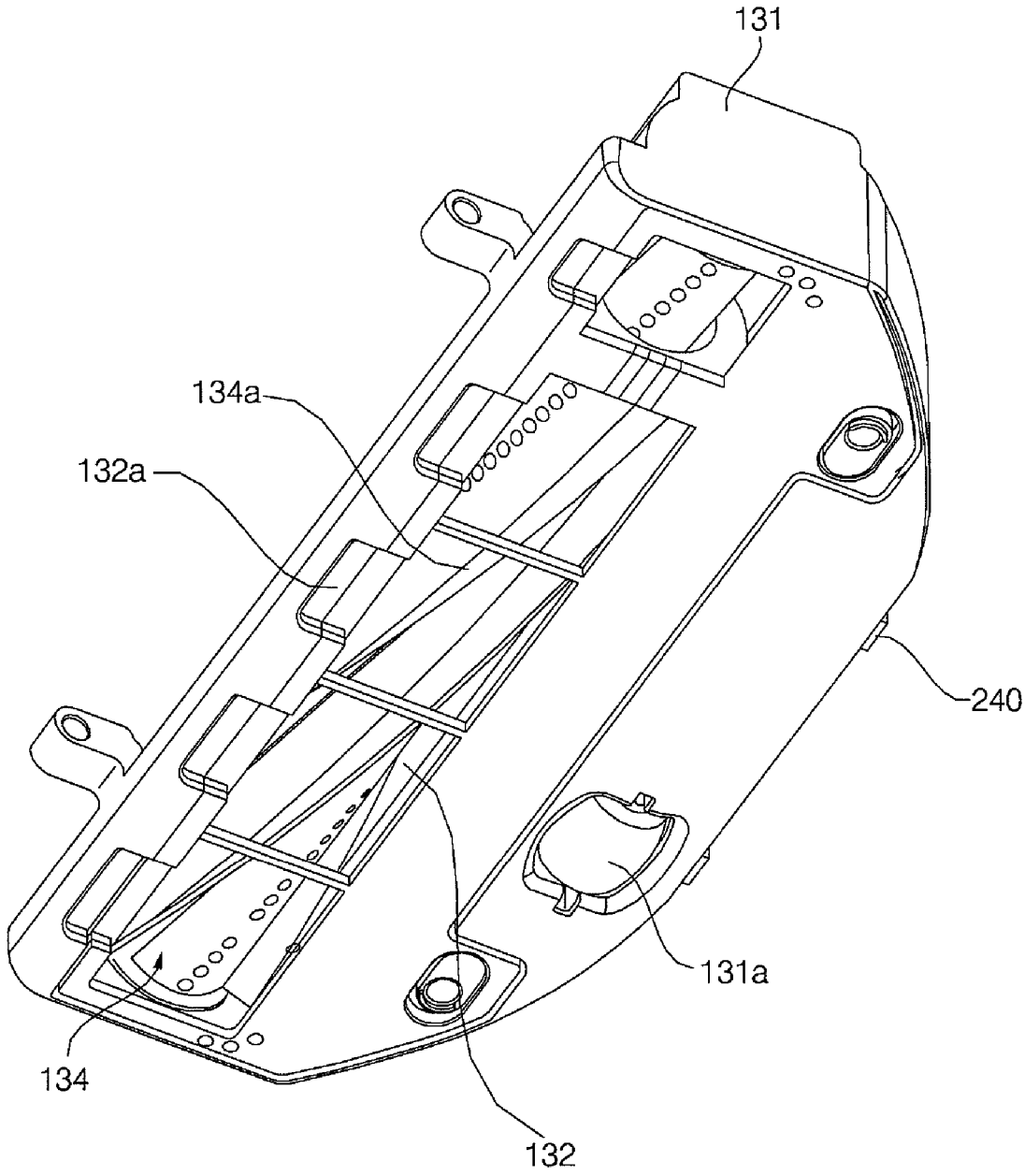
FIG. 5 is a bottom perspective view illustrating a suction nozzle unit of the cleaning robot as illustrated in FIG. 2.

Referring to FIGS. 4 and 5, the suction nozzle unit 130 may include a nozzle case 131 having a suction port 132 and an exhaust port 133 formed therein. The nozzle case 131 and the suction port 132 are configured to be installed in the case 110, and an agitator 134 may be installed inside the nozzle case 131, i.e., at the suction port 132 side, for agitating dust on a surface (e.g., a floor).

The suction port 132 may be formed to communicate with the lower surface of the case 110, i.e., so as to face the floor, while the exhaust port 133 may be formed to communicate with the dust collector 140, thereby guiding the air sucked from the suction port 132 to the dust collector 140.

An auxiliary wheel 131*a* is installed on the lower surface of the nozzle case 131 so as to prevent the suction port 132 from tightly contacting the floor.

The suction port 132 suctions foreign material on the floor by an air suction force generated by the air suction device 120, and the exhaust port 133 may be connected to the dust collector 140 through a communicating tube 133*a* of FIG. 2.

A plurality of suction grooves 132*a* may be formed on the lower surface of the nozzle case 131 in a forward and backward traveling direction of the cleaning robot. The suction grooves 132*a* may form a passage which prevents the suction port 132 from being blocked by foreign material on the floor at the front of the nozzle case 131, thereby preventing an overload of the motor provided on the air suction device 120.

Both ends of the agitator 134 may be connected to both side walls of the suction port 132 so as to be rotatable, and rotates or angularly reciprocates so as to shake the dust off the floor or carpet and floating it in the air.

A plurality of blades 134*a* provided in a spiral direction may be formed on the outer circumferential surface of the agitator 134, and a brush may be installed between the blades 134*a* formed in a spiral shape.

For the operation of the agitator 134, an agitator motor 134*b* and a belt 134*c* functioning as power transmission equipment for transmitting power of the agitator motor 134*b* to the agitator 134 may be provided on the nozzle case 131.

When a rotation force of the agitator motor 134*b* is transmitted to the agitator 134 through the belt 134*c*, the agitator 134 may sweep the foreign material on the floor to the suction port 132 while rotating.

Figure 6:
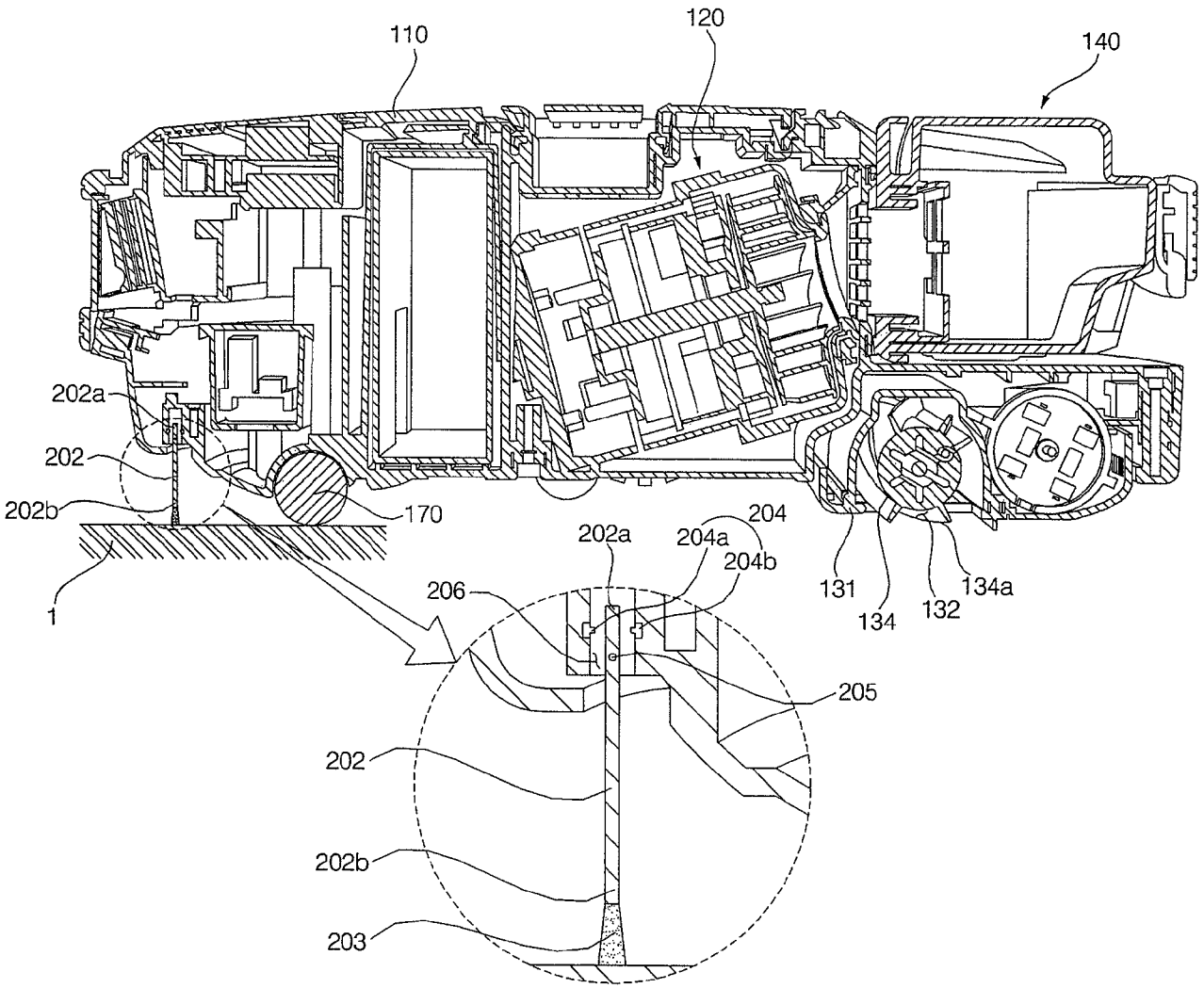
FIG. 6 is a cross sectional view of the cleaning robot illustrating a drop-off detection unit as illustrated in FIG. 1.
Figure 7A:
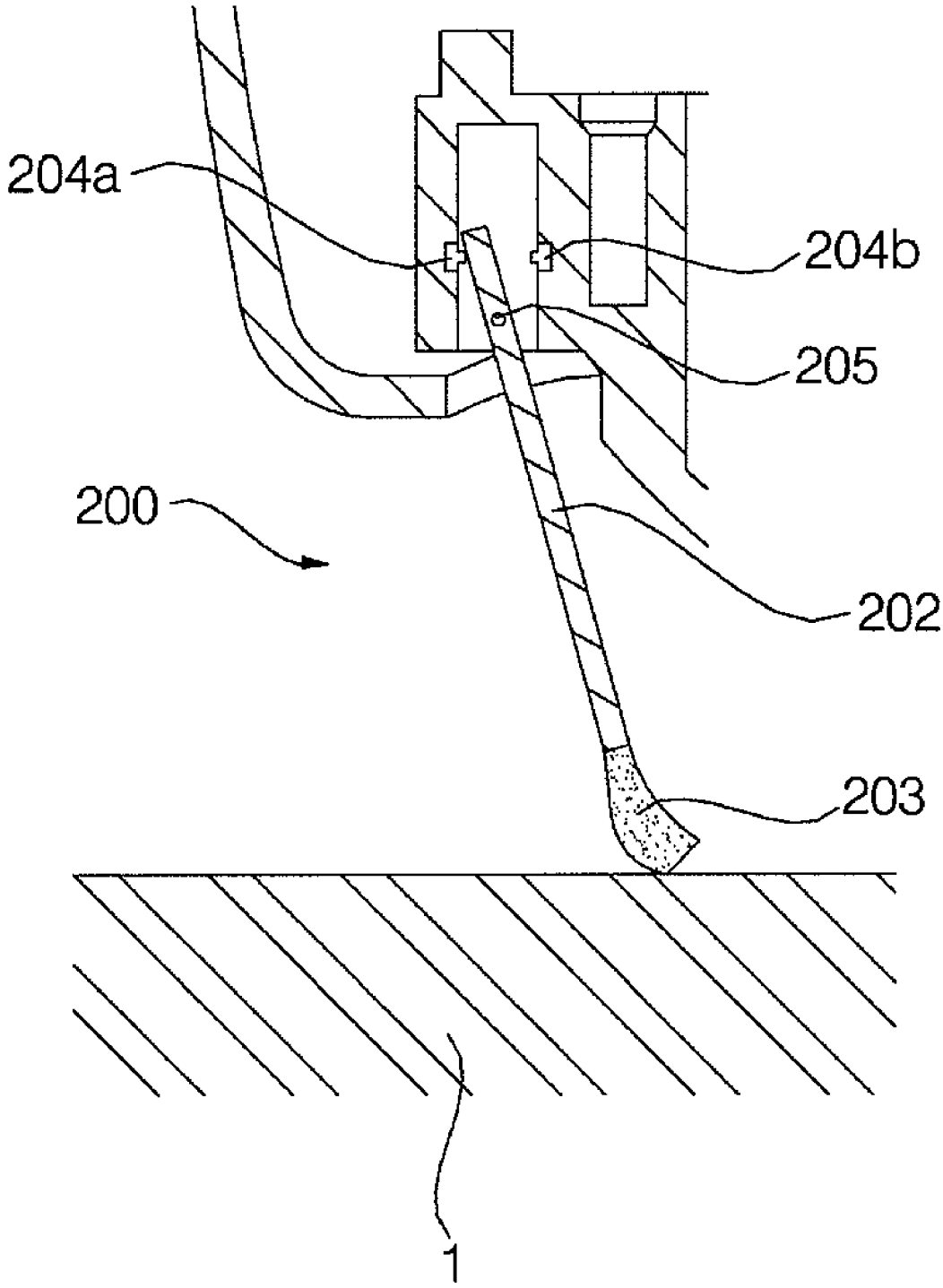
FIGS. 7A to 7C are schematic cross sectional views illustrating an operating procedure of the drop-off detection unit as illustrated in FIG. 6.
Figure 7B:
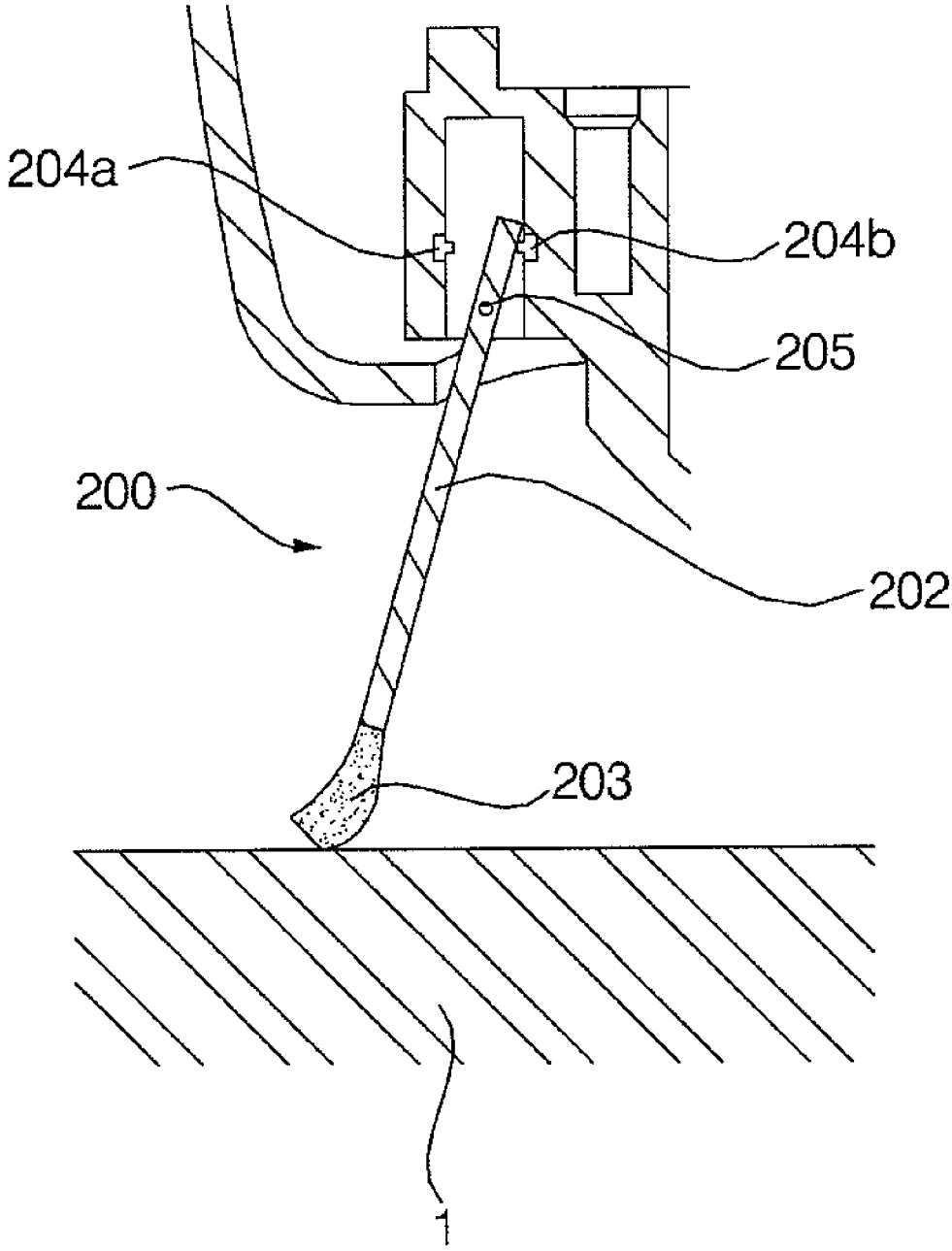
Figure 7C:
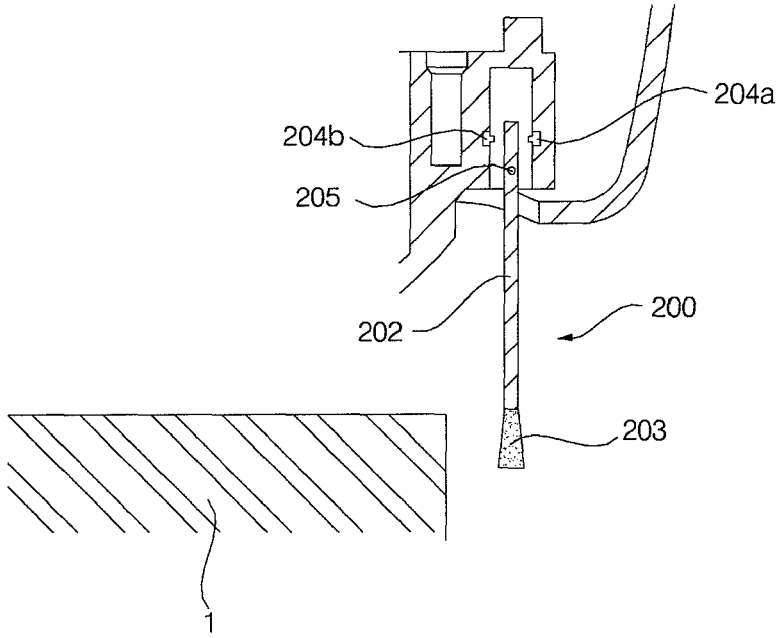
Figure 8:
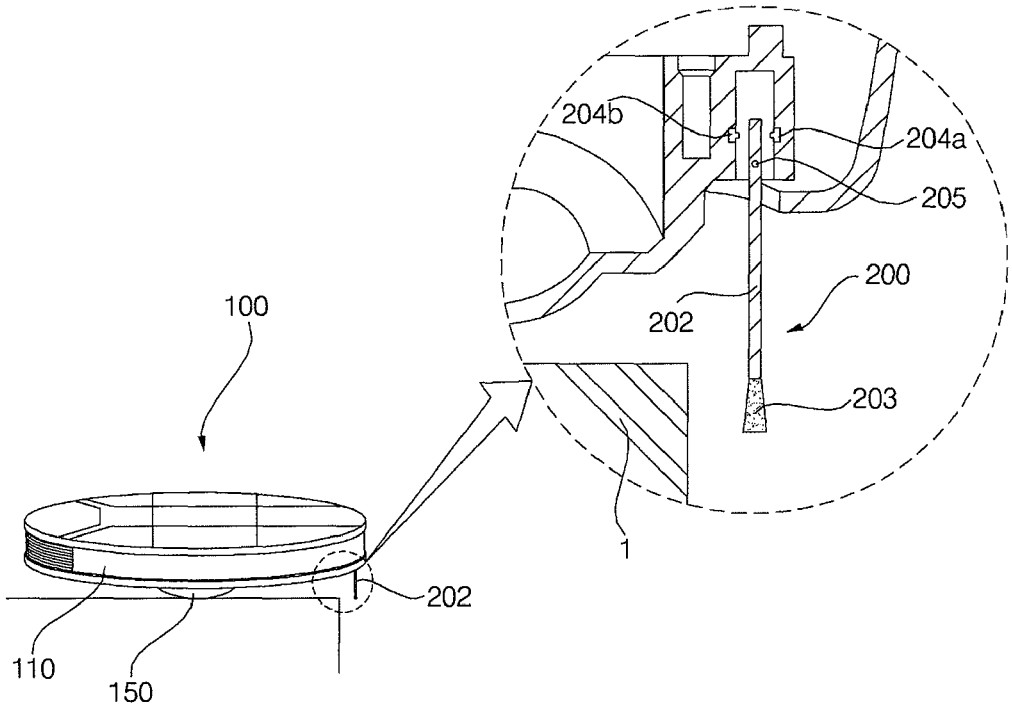
FIG. 8 is an exemplified view illustrating a drop detection state of the drop-off detection unit as illustrated in FIG. 6.

FIG. 6 is a cross sectional view of the cleaning robot illustrating a drop-off detector as illustrated in FIG. 1. FIGS. 7A to 7C are schematic cross sectional views illustrating an operating procedure of the drop-off detector as illustrated in FIG. 6. FIG. 8 is an exemplified view illustrating a drop detection state of the drop-off detector as illustrated in FIG. 6.

As illustrated in FIG. 3 or FIGS. 6 to 8, the cleaning robot according to the present invention has a drop-off detector 200 installed (or provided) on the case 110 and configured to directly contact (or engage) a surface, e.g., a floor 1, to detect a drop-off.

The drop-off detector 200 may include a contact bar 202 installed (or provided) on the case 110. Additionally, a switch 204 may be installed (or provided) on the case 110, the switch 204 being configured to contact the contact bar 202 during movement of the cleaning robot.

The contact bar 202 may be connected to the case 110 through a hinge 205, and the hinge 205 may be installed (or provided) so as to rotate in a back and forth direction during back and forth movement of the cleaning robot. However, one of ordinary skill in the art would appreciate that any suitable mechanism or arrangement may be employed to connect the hinge 205 to the case 110.

In this regard, the contact bar 202 may be configured to rotate around (or about) the hinge 205 during back and forth movement of the cleaning robot, and the switch 204 may be disposed at (or provided on) an installation slot 206 of the case 110.

The installation slot 206 may be formed having an opening at the bottom side, one end of the contact bar 202 may be inserted into the installation slot 206, and one end 202*a* of the contact bar 202 and the switch 204 may contacted each other. For example, the installation slot 206 may be formed so as to open toward the floor 1, and may cross or intersect a surface, e.g., the floor 1 at a predetermined angle.

The switch 204 may be any suitable detector which detects contact between the contact bar 202 and the floor 1, and may be installed either at the case 110 side or at the contact bar 202 side. In FIG. 7A, the switch 204 is shown installed at the case 110 side. However, one of ordinary skill in the art would appreciate that the switch 204 may be provided at any suitable position to provide contact with the contact bar 202.

Further, the switch 204 may include a front switch 204*a* configured to contact one end 202*a* of the contact bar 202 during forward movement of the cleaning robot and a rear switch 204*b* configured to contact one end 202*a* of the contact bar 202 during backward movement of the cleaning robot.

The front switch 204*a* may be provided at the front side of the case 110, and the rear switch 204*b* may be provided at the rear side of the case 110. The switch 204 may be connected to a controller 180 of the cleaning robot. In this regard, the switch may transmit an electrical signal to the controller 180 when the front/rear switches 204*a* and 204*b* are pressed by the contact bar 202.

On the tip end 202*b* of the contact bar 202, a contact member (or surface contact) 203 contacting the floor 1, thereby increasing a frictional force with the floor 1, may be installed (or provided).

The contact member 203 may be formed of flexible rubber or synthetic resin so that the contact bar 202 can rotate smoothly around the hinge 205 when the contact member 203 comes into contact with the floor 1.

Further, the contact member 203 may be formed of flexible material, so that it does not scratch a surface when, e.g., the floor 1 and the contact bar 202 contact each other.

Although not shown, when no external force is applied to the contact bar 202, a torsion spring which may be an elastic member (or spring), may be installed on the hinge 205. In this regard, an elastic force may be provided to the contact bar 202 so that there is no contact with any of the switches 204*a* and 204*b*.

Hereinafter, an operating procedure of the drop-off detector will be described in more detail with reference to FIGS. 7A to 7C and FIG. 8.

First, as illustrated in FIG. 7A, when the cleaning robot moves forward the case 110 is moved forward by a driving force transmitted to driving wheels 150 and 160, and the contact bar 202 installed on the case 110 may also move forward while contacting the floor 1.

For example, the contact bar 202 may rotate around (or about) the hinge 205 due to a frictional force caused by engagement of the contact bar 202 with the floor 1 so that one end 202*a* comes into contact with the front switch 204*a*, and the front switch 204*a* transmits an electrical signal to the controller 180.

That is, the controller 180 recognizes a contact between the tip end 202*b* of the contact bar 202 and the floor 1 by receiving a signal generated upon contact between the front switch 204*a* and the contact bar 202.

Moreover, as illustrated in FIG. 7B, if the cleaning robot goes backward, the contact bar 202 comes into contact with the rear switch 202*b*, and the controller 180 recognizes a contact between the tip end 202*b* of the contact bar 202 and the floor 1 due to contact between the rear switch 204*b* and the contact bar 202.

Meanwhile, as illustrated in FIGS. 7C and 8, when the cleaning robot is moved near a drop-off (i.e., an edge from which the cleaning robot may drop) and the contact bar 202 is positioned in an area around (or proximate) the drop-off such that the contact bar 202 no longer contacts any of the front/rear switches 204*a* and 204*b*, the controller 180 determines that there is a drop-off in a movement direction of the cleaning robot.

That is, the drop-off detector 200 according to the present invention detects a drop-off due to a contact state between the contact bar 202 and the switch 204 irrespective of the color, reflectivity, material, surface state, etc. of the floor 1.

Further, though not shown, a plurality of drop-off detectors 200 may be installed around the case 110.

Figure 9A:
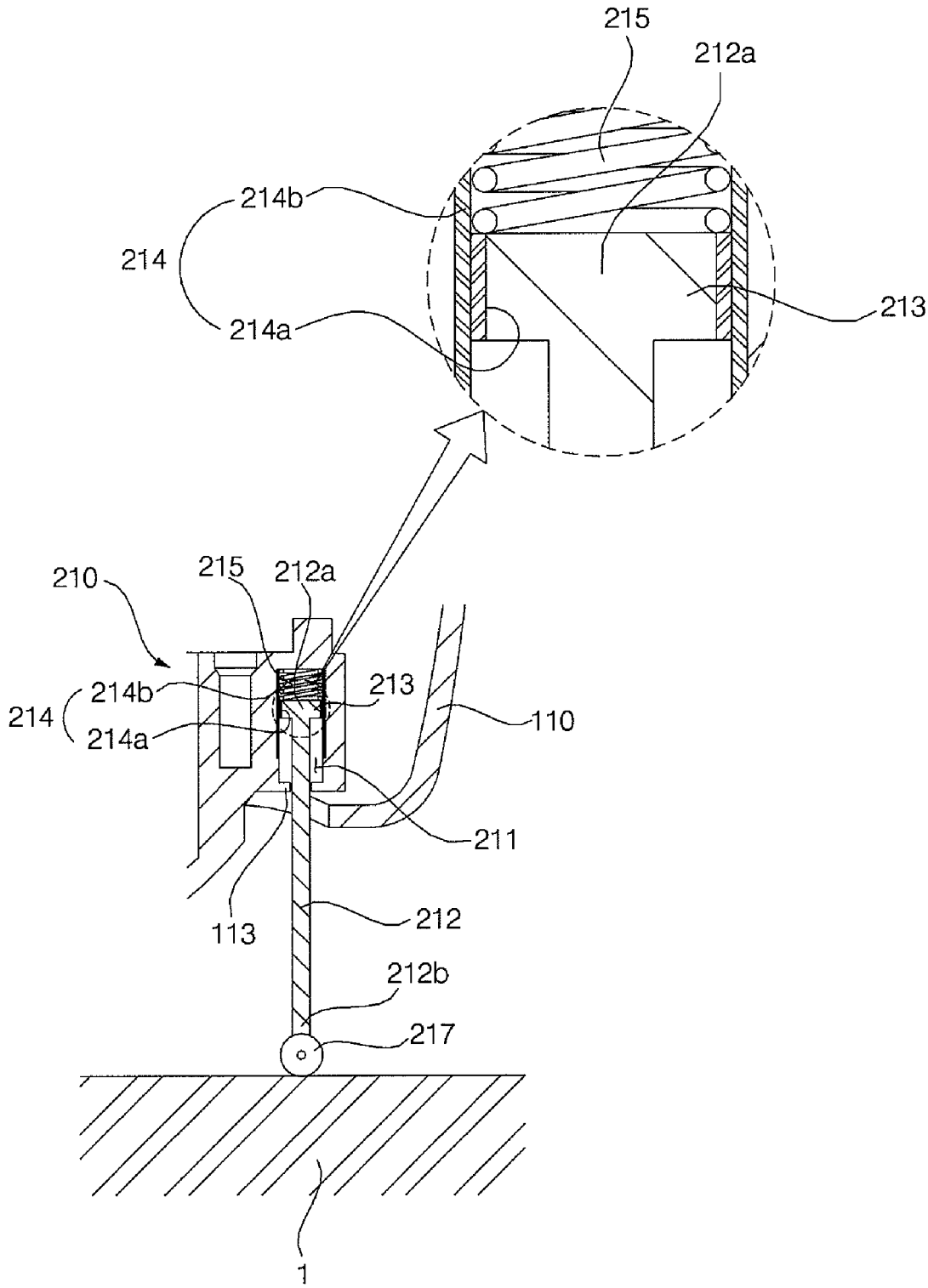
FIGS. 9A to 9C are cross sectional views illustrating a drop-off detection unit according to a second embodiment of the present invention.
Figure 9B:
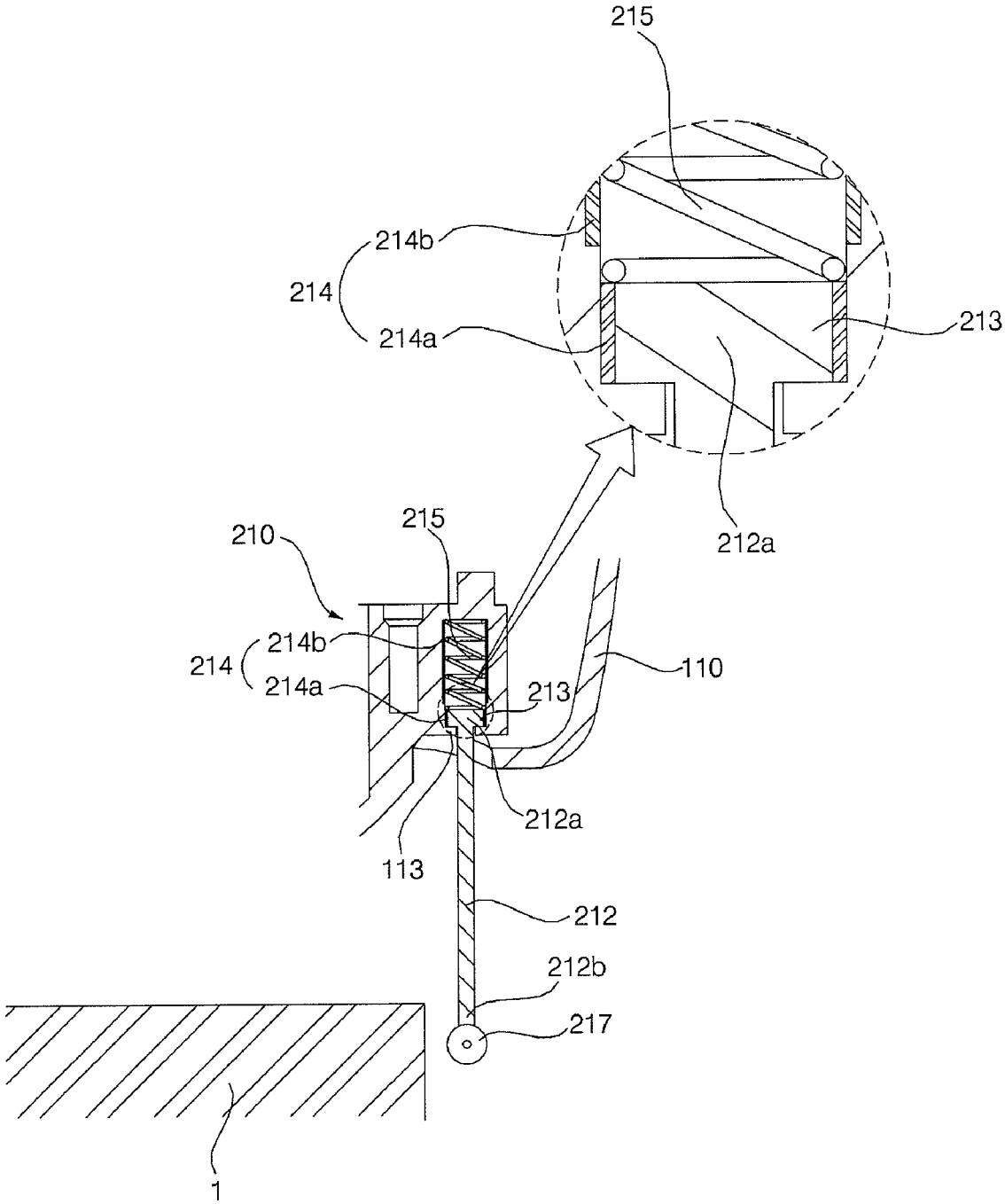
Figure 9C:
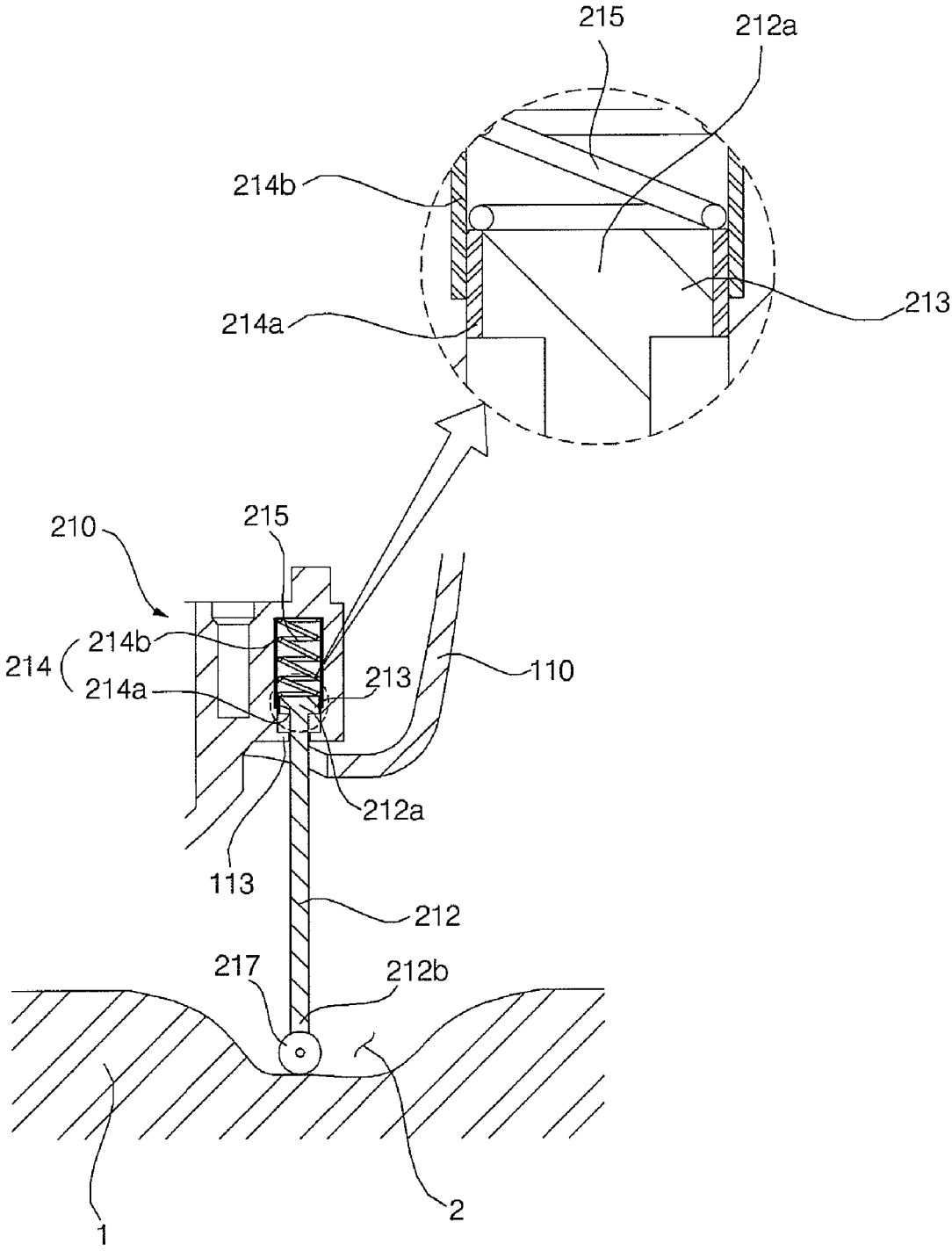

FIGS. 9A to 9C are cross sectional views illustrating a drop-off detector according to a second embodiment of the present invention.

As illustrated in FIGS. 9A through 9C the drop-off detector 210 of the second embodiment includes an installation slot

211 having an opening provided at a lower side and formed on the case 110, a contact bar 212 moving in an up and down direction along the installation slot 211, an elastic member (e.g., coil spring) installed between the case 110 and the contact bar 212 to provide an elastic force to the contact bar 212, and a position sensor 214 which may be any suitable detector installed (or provided) between the contact bar 212 and the case 111, the position sensor 214 being configured to sense the position of the contact bar 212, e.g., relative to a floor surface 1.

In this regard, the contact bar 212 may be longitudinally formed in the up and down direction (e.g. generally vertically extending) so that one end 212*a* may be positioned within the installation slot 211 and the other end 212*b* may be configured to contact the floor 1, and the contact bar 212 slidably moves in the up and down direction according to the state of the floor 1.

At one end 212*a* of the contact bar 212, a stopping portion 213 may be formed so as to move along the installation slot 211 and stop at a stopping portion 113 which may be provided on the case 110.

Further, a roller 217 for minimizing friction with the floor 1 may be installed at the other end of the contact bar 212. In this regard, the roller 217 may minimize the generation of a scratch on the floor by rotating about the tip end 212*b* of the contact bar 212 during movement of the cleaning robot.

The elastic member 215 may be a spring which provides a downward elastic force to the contact bar 212. In this regard, when the contact bar is positioned at a drop-off, the contact bar 212 is moved to the lowermost side by the elastic force of the elastic member 215.

Although a spring is used as the elastic member 215 in this embodiment, various materials having elasticity may be employed without departing from the spirit or scope of the present invention.

The position sensor 214 may include a first electrode 214*a* disposed (or provided) on the contact bar 212 and a second electrode 214*b* disposed (or provided) on the installation slot 211.

Therefore, the controller 180 may determine that when there is contact between the first and second electrodes 214*a* and 214*b*, the cleaning robot is positioned on the floor 1, and when there is no contact between the first and second electrodes 214*a* and 214*b*, a cliff is positioned in the traveling direction of the cleaning robot.

That is, when the contact bar 212 is positioned on the floor 1, as the contact bar 212 compresses the elastic member 215, the stopping portion 213 is positioned at an upper side, thereby making the first and second electrodes 214*a* and 214*b* contact with each other; therefore, the controller 180 may receive a signal that the first and second electrodes 214*a* and 214*b* are in contact, and determine that the cleaning robot is positioned on the floor.

On the other hand, when the contact bar 212 is positioned in the air around the drop-off, the contact between the first and second electrodes 214*a* and 214*b* is released, and the controller 180 may receive a release signal indicating that the first and second electrodes 214*a* and 214*b* are no longer in contact; therefore, the controller 180 determiners that there is a drop-off in the traveling direction or position of the cleaning robot.

The drop-off detector 210 according to the second embodiment is able to detect a drop-off through (or via) signals of the first and second electrodes 214*a* and 214*b* even when the cleaning robot is stopped (i.e., not moving).

Furthermore, when a groove 2 or valley is formed on the surface of the floor 1, the drop-off detector 210 according to the second embodiment prevents a drop-off from being recognized in the groove 2 or valley because the contact bar 212 is tightly contacted with the surface of the groove 2 while moving downward.

Hereinafter, the other components according to the second embodiment are identical to those of the first embodiment, so a detailed description thereof will be omitted.

Figure 10:
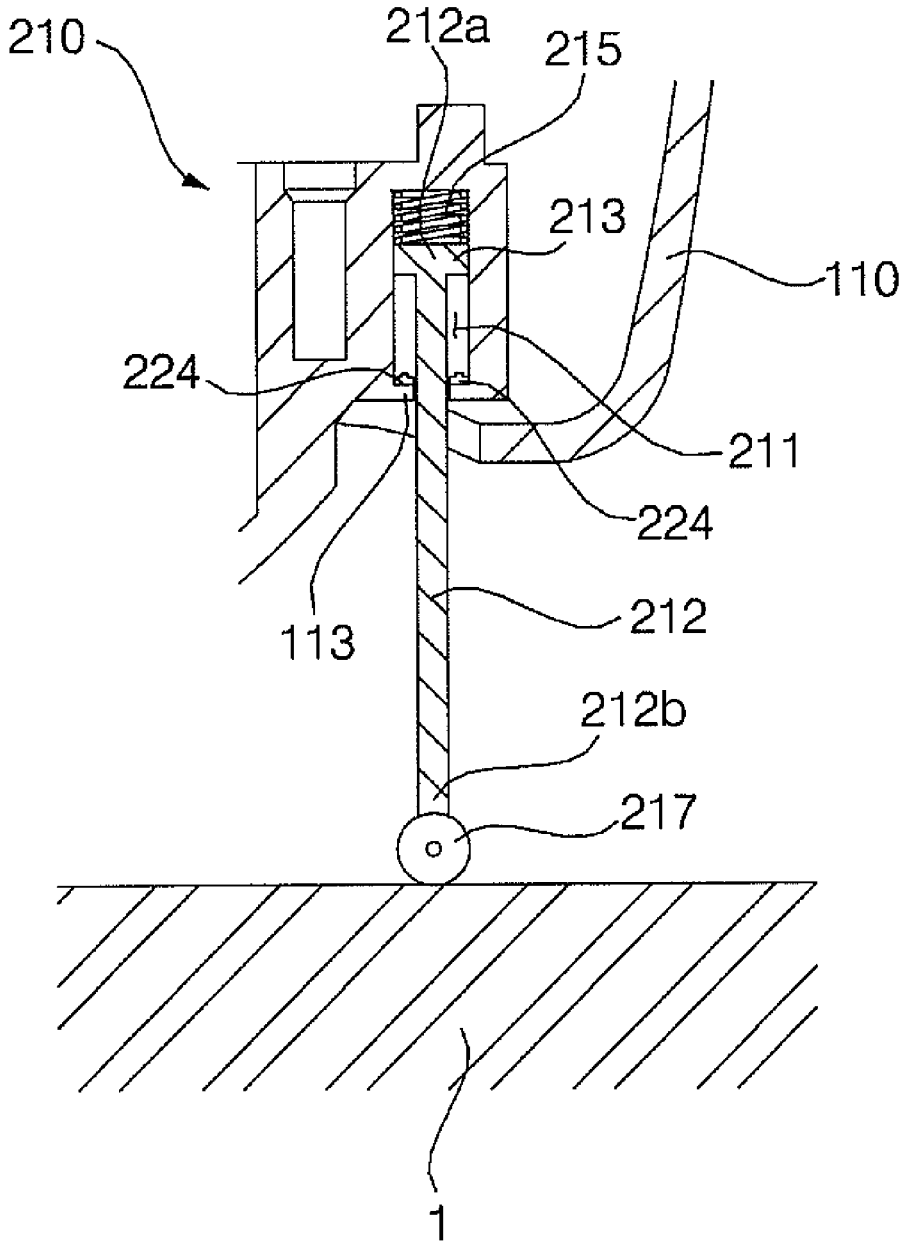
FIG. 10 is a cross sectional view illustrating a drop-off detection unit of a cleaning robot according to a third embodiment of the present invention.

FIG. 10 is a cross sectional view illustrating a drop-off detector of a cleaning robot according to a third embodiment of the present invention.

As illustrated in FIG. 10, the third embodiment provides a position sensor 224, which senses the position of the contact bar 212, installed at the lowermost side of the installation slot 211.

Therefore, when the contact bar 212 moves to the lowermost side of the installation slot 211 by the elastic force of the elastic member 215, the position sensor 224 is pressed by the contact bar 212, and the controller 180 detects this signal and determines that the cleaning robot is positioned on a drop-off.

Hereinafter, the other components according to the third embodiment are identical to those of the second embodiment, so a detailed description thereof will be omitted.

Figure 11:
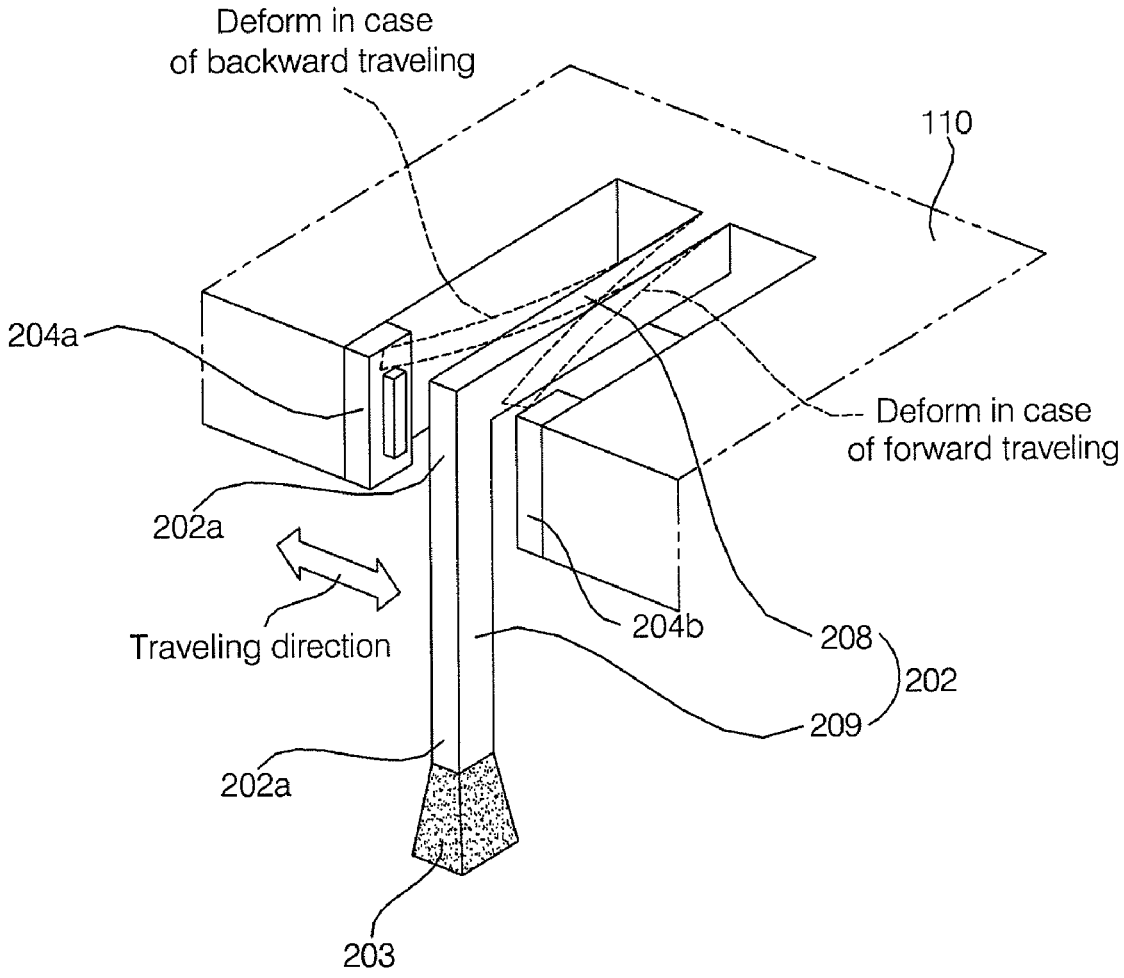
FIG. 11 is a cross sectional view illustrating a drop-off detection unit according to a fourth embodiment of the present invention.

FIG. 11 is a cross sectional view illustrating a drop-off detector according to a fourth embodiment of the present invention.

As illustrated in FIG. 11, in the fourth embodiment, a contact bar 202 may be formed integral with the case 110, and configured to contact the front/rear switches 204*a* and 204*b* as it is bent by the elasticity of the material.

Therefore, the contact bar 202 may be formed longitudinally in the up and down direction (i.e., extending generally vertically) as shown in the first embodiment, and connected to the case 110 so as to cross at a predetermined angle to the movement direction of the cleaning robot so that a bend is generated according to the movement direction of the cleaning robot.

Thus, the contact bar 202 may include a deflection portion 208 fixed to the case 110 and a contact portion 209 formed so as to transverse the deflection portion 208 and contact the floor 1.

Here, the deflection portion 208 and the contact portion 209 may be made of the same material, or only the deflection portion 208 may be formed of a material elastically deformed by a frictional force.

Hereinafter, the other components according to the fourth embodiment are identical to those of the third embodiment, so a detailed description thereof will be omitted.

The present invention shall not be limited by the embodiments and drawings disclosed in this specification but may be applicable by those skilled in the art without departing from the scope of protection of the true spirit of the invention.

Subsequently, the cleaning robot according to the present invention is able to detect a floor irrespective of the material of a floor, the surface state, the color, etc. because it has a drop-off detector installed (or provided) therein, and configured to directly contact (or engage) a surface in order to detect the existence or nonexistence of a surface, e.g., a floor surface.

Additionally, the cleaning robot according to the present invention improves the accuracy of detection of a drop-off to a large extent as compared to an optical sensor in which the reception of electrical waves changes according to the material of a floor, the surface state, the color, etc.

Additionally, the present invention is able to directly detect a floor by using a drop-off detector during both of the movement and stopping of the cleaning robot.

Additionally, the cleaning robot according to the present invention can minimize a detection error of a drop-off because the movement of the contact bar generated by a contact between the contact bar and the floor is detected through the switch or position sensor.

Additionally, the cleaning robot according to the present invention has a simple installation structure because the switch may be operated as the contact bar is rotated around the hinge.

Additionally, the cleaning robot according to the present invention has a simple configuration because the switch may be operated as the contact bar is elastically deformed.

Additionally, the cleaning robot according to the present invention can prevent unevenness on the floor from being recognized as a drop-off because the existence or nonexistence of a floor may be detected as the contact bar slidably moves up and down.

It is further noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A robot cleaner comprising:

a case;

a contact bar rotatably connected to the case and extending from the case for directly contacting the floor; and a position sensor disposed in the case and positioned for engagement with a lateral movement of the contact bar relative to the floor during movement of the case and becoming disengaged when the contact bar detects the nonexistence of the floor during said movement, wherein the position sensor includes a first electrode disposed on the contact bar and a second electrode disposed on the case and adapted to interact with the first electrode.

2. The robot cleaner of claim 1, wherein the contact bar is rotatably connected to the case through a hinge to enable relative rotation around the hinge during back and forth movement of the case.

3. The robot cleaner of claim 1, wherein the case contains an installation slot which rotatably accommodates the contact bar and the position sensor is disposed on opposite sides of a slot, whereby upon the movement of the case, the contact bar is adapted to engage the position sensor.

4. The robot cleaner of claim 3, wherein the contact bar has a first end portion which extends into the installation slot for engagement with the position sensor and a second end portion which contacts the floor, whereby the movement of the case causes the lateral movement of said first and second end portions relative to the floor.

5. The robot cleaner of claim 4, wherein the second end portion of the contact bar includes a contact member for engagement with the floor.

6. The robot cleaner of claim 5, wherein the contact member is a flexible member.

7. The robot cleaner of claim 4, wherein the second end portion of the contact bar is provided with a roller.

8. The robot cleaner of claim 3, wherein the installation slot is formed in the case orthogonal to the floor.

* * * * *